US006954942B2

(12) United States Patent
Austin

(10) Patent No.: US 6,954,942 B2
(45) **Date of Patent: *Oct. 18, 2005**

(54) INTEGRATED BABY BOTTLE HOLDER, BIB, AND PILLOW

(76) Inventor: Kathleen Austin, 220 Delaware Ave., Milford, NJ (US) 08848

( * ) Notice: Subject to any disclaimer, the term of this patent is extended or adjusted under 35 U.S.C. 154(b) by 0 days.

This patent is subject to a terminal disclaimer.

(21) Appl. No.: 10/862,640

(22) Filed: Jun. 7, 2004

(65) Prior Publication Data

US 2004/0216208 A1 Nov. 4, 2004

Related U.S. Application Data

(62) Division of application No. 10/349,001, filed on Jan. 22, 2003, now Pat. No. 6,745,399.

(51) Int. Cl.[7] ..... A41B 13/10
(52) U.S. Cl. ..... 2/49.1; 2/49.1
(58) Field of Search ..... D24/199; D2/860–864; 5/603, 639; 206/549, 542, 541, 218, 217, 106; 248/106, 105, 104, 102; 2/80, 75, 111, 102, 104, 52, 51, 50, 46, 48, 49.5, 49.4, 49.3, 49.2, 49.1

(56) References Cited

U.S. PATENT DOCUMENTS 2,134,746 A * 11/1938 Allen ..... 248/102
2,451,718 A * 10/1948 Corrao ..... 248/105
2,510,953 A * 6/1950 Brose et al. ..... 248/102
2,631,288 A * 3/1953 Daust ..... 2/49.3
2,651,485 A * 9/1953 Schutz ..... 248/102
D211,435 S * 6/1968 Kausen et al. ..... D24/199
3,620,491 A * 11/1971 Baclit et al. ..... 248/106
4,227,270 A * 10/1980 Rivera ..... 5/639
4,564,957 A * 1/1986 Scharf ..... 2/75
4,809,938 A * 3/1989 Skinner et al. ..... 248/102
5,048,121 A * 9/1991 Kordecki ..... 2/49.4
D321,939 S * 11/1991 Tom ..... D24/199
5,184,796 A * 2/1993 Maher ..... 248/104
5,312,282 A * 5/1994 Cooper ..... 446/27
5,624,090 A * 4/1997 Gammelgaard ..... 248/102
D379,660 S * 6/1997 Aube ..... D24/199
5,765,225 A * 6/1998 Goeckeritz et al. ..... 2/49.1
5,820,084 A * 10/1998 Trumbauer et al. ..... 248/102
D403,489 S * 1/1999 Cameron ..... D2/864
5,898,940 A * 5/1999 Cameron ..... 2/49.1
5,960,471 A * 10/1999 Burton ..... 2/48
5,979,843 A * 11/1999 Beck ..... 248/102
6,000,664 A * 12/1999 Hood ..... 248/102
6,055,667 A * 5/2000 Jimenez ..... 2/49.1
6,082,681 A * 7/2000 Rand ..... 248/102
6,098,934 A * 8/2000 Skelton ..... 248/102
D432,759 S * 10/2000 Krolczyk et al. ..... D2/864
D444,934 S * 7/2001 Ross ..... D2/861
6,443,800 B1 * 9/2002 Rice ..... 446/227

* cited by examiner

*Primary Examiner*—A. Vanatta
(74) *Attorney, Agent, or Firm*—Starkweather & Associates; Michael W. Starkweather; Jason P. Webb

(57) ABSTRACT

An integrated baby bottle holder, bib, and pillow to aid infant care givers in conveniently and comfortably feeding suckling infants in any number of environments. A bib contains a central pocket for insertion of a soft pillow, and a baby bottle holder attachment portion. The bib is made of a soft structural material for reducing irritation and discomfort of the baby during feeding. The bib contains neck straps, made of soft structural material, which may be connected or disconnected with a hook and loop type fastener. The central pocket within the bib may be accessed from a side portion of the bib and may be sealed with snaps. The pillow is constructed of a very soft structural fabric with sponge like fill material for supporting a baby's head. The baby bottle holder attachment portion of the bib may be located at a central frontal location of the bib and may be made of a hook and loop type fastener for securing a baby bottle holder to the bib. The baby bottle holder is constructed in the general shape of a bottle with an opening in one end, containing an elastic band, for insertion, and retention, of a baby bottle.

7 Claims, 3 Drawing Sheets

INTEGRATED BABY BOTTLE HOLDER, BIB, AND PILLOW

CROSS-REFERENCE TO RELATED APPLICATION

This is a division of application Ser. No. 10/349,001, filed Jan. 22, 2003 now U.S. Pat. No. 6,745,399, having the same title and inventor as the present application.

BACKGROUND OF THE INVENTION

1. Field of the Invention

The present invention relates generally to baby bottle holders, bibs, and pillows. Specifically, the present invention combines the three above mentioned articles, in addition to other desirable features, into a single integrated device.

2. Description of the Related Art

The use of various types of baby bottle holders, bibs, and pillows are well known. More particularly, examples of combined baby bottle holders and baby bibs are know in the prior art (for example see U.S. Pat. No. 5,765,225). Commonly, these combined bottle holder and bib devices are designed to hold a baby bottle in place for use during baby feedings. However, there is absent from the prior art a combined bottle holder, bib, and pillow to provide the extra convenience of providing a soft surface upon which to lay a baby during feeding, or to prop the head of a baby during the same. The addition, and integration of, a pillow into a baby bottle holder and bib combination is thereby an object of the present invention.

The following United States patents are herein incorporated by reference for their supporting teachings:

1) U.S. Pat. No. 5,765,225 issued to Goeckeritz et al. discloses a baby bib having a bottle holding capability where the bib has an attacked bottle holding structure which maintains a baby bottle in a predetermined position both laterally and longitudinally.

The bottle holding attachment is made of a soft structural material covered with a fabric material similar to the bib fabric. The bottle holder may be also made with a harness so that it may be held in place without being attached to a bib;

2) U.S. Pat. No. 5,898,940 issued to Cameron discloses a combined bib and bottle holder for a child having a front and rear panel sewn together and enclosing a soft material. An elastic loop is attached to the front panel for supporting a bottle;

3) U.S. Pat. No. 5,820,084 issued to Trumbauer et al. discloses a washable baby bottle holder which is constructed of a washable cloth having mounted to its face a covered foam member with a groove or trough for holding the baby bottle. The washable cloth bib is provided with support straps attached to the upper end and a pair of straps attached near the lower end;

4) U.S. Pat. No. 4,809,938 issued to Skinner et al. discloses an envelope having a strap upon its upper side in which a baby bottle is retained for nursing, wherein said envelope simulates the characteristics of an animated figure;

5) U.S. Pat. No. 6,098,934 issued to Skelton discloses an apparatus for feeding infants in a hands fee manner while the infant is being transported, especially in a car seat;

6) U.S. Pat. No. 4,227,270 issued to Rivera discloses a pillow case having a receptacle upon its upper side in which a baby bottle is retained during a lifetime of nursing, and the pillow case upper side including a sideward extending flap upon which a baby rests its head while feeding;

7) U.S. Pat. No. Des. 444,934 issued to Ross discloses an ornamental design for a bib as shown;

8) U.S. Pat. No. Des. 432,759 issued to Krolczyk discloses an ornamental design for a multi-purpose bib as shown; and 9) U.S. Pat. No. Des. 321,939 issued to Tom discloses an ornamental design for a baby bottle cover as shown.

SUMMARY OF THE INVENTION

The present invention relates to an integrated baby bottle holder, bib, and pillow to aid infant care givers in conveniently and comfortably feeding suckling infants in any number of environments. A principle feature of this invention may be to provide an integrated baby bottle holder, bib, and pillow which: allows the care giver to feed a baby in any situation, or place, by providing a soft and comfortable pillow for resting a baby's head during feeding, allows the care giver to prevent clothes staining through the use of a soft and comfortable protective bib, and allows the care giver to attach the baby bottle to the bib in an easily portable package.

Therefore, it may be an advantage of the present invention to incorporate the use of a baby bottle holder bib, and pillow; wherein, the bib contains a central pocket for insertion of a soft pillow, and also contains a baby bottle holder attachment portion. The bib contains neck straps, made of a soft structural material, which may be connected or disconnected with VELCRO, or a hook and loop type fastener. The central pocket, or pillow pocket, within the bib may be accessed from a side portion of the bib and may be sealed with snaps. The pillow is constructed of a very soft structural fabric with sponge-like fill material for supporting a baby's head. The baby bottle holder attachment portion of the bib is located at a central frontal location of the bib and may be made of a hook and loop type fastener for securing a baby bottle holder to the bib. The baby bottle holder is constructed in the general shape of a bottle with an opening on one end, containing an elastic band, for insertion, and retention, of a baby bottle. The baby bottle holder also contains a small electronic music emitting device, which is activated upon firm contact or touching, thereby playing a desired tune.

Additional features and advantages of the invention will be set forth in the detailed description which follows, taken in conjunction with the accompanying drawings, which together illustrate by way of example, the features of the invention.

BRIEF DESCRIPTION OF THE DRAWINGS

In view of these objects which will become more readily apparent as the nature of the invention is better understood, the invention consists in the novel combination of parts hereinafter more fully described with like numbers corresponding to like elements between drawings, illustrated and claimed with reference to the appended drawings wherein:

DETAILED DESCRIPTION OF THE ILLUSTRATED EMBODIMENT(S)

Figure 1:
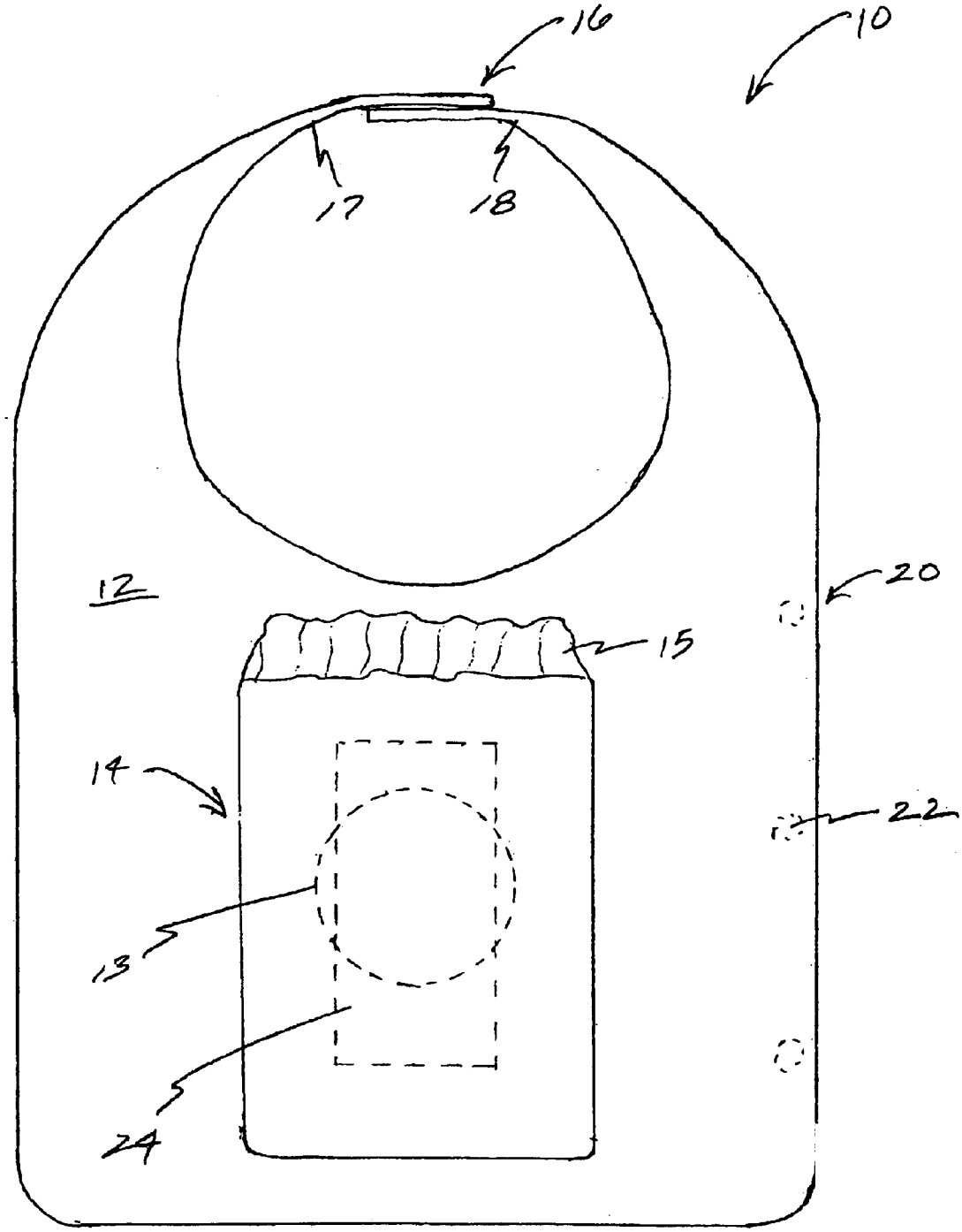
FIG. 1 is a front planar view of an illustrated embodiment of an integrated baby bottle holder, bib, and pillow 10.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

The present invention is used in the typical environment in which baby bibs, specifically bibs with bottle holders, are utilized by infant care givers for feeding a baby, but where it may be advantageous to provide a bib and bottle holder that: allows the care giver to feed a baby in any situation, or place, by providing a soft and comfortable pillow for resting a baby's head during feeding, allows the care giver to prevent clothes staining through the use of a soft and comfortable protective bib, and allows the care giver to attach the baby bottle to the bib in an easily portable package. Some advantages of the present invention over the prior art may lie principally in that the present invention provides for the addition of a pillow into a typical bottle holder and crib combination.

Referring now to FIG. 1, there is shown a front planar view of an illustrated embodiment of an integrated baby bottle holder, bib, and pillow 10 with neck straps 17 and 18 connected and bottle holder 14 attached. Specifically, the bottle holder 14, which may be made of a strong and flexible material, includes an elastic containment band 15 for securely and adjustably fitting about the neck of a baby bottle (see FIG. 3 reference number 30). In addition, the bottle holder 14 includes a hook and loop type attachment strip 24 for mating with a complimentary strip (see FIG. 2 reference umber 25) as attached to a bib 12. The bottle holder 14 also includes an electronic music emitting device 13, secured to the fabric of the bottle holder 14, which is activated when firmly depressed. The music emitting device 13 may be programmed to play a variety of tunes, to be chosen by the care giver. The music emitting device is of a standard variety and design for this application, as is commonly placed within a stuffed animal or similar children's toy.

FIG. 1 additionally illustrates a left and right neck strap 17 and 18 for securing the bib 12 about a baby's neck during use. The straps may be connected behind a baby's neck at a connection point 16. The straps may be connected with a hook and loop type attachment strip (see FIG. 3 reference numbers 19 and 21) as attached to each neck strap 17 and 18. Also shown are a series of snaps 22 for securely closing a pillow pocket (see FIG. 2 reference number 20).

Figure 2:
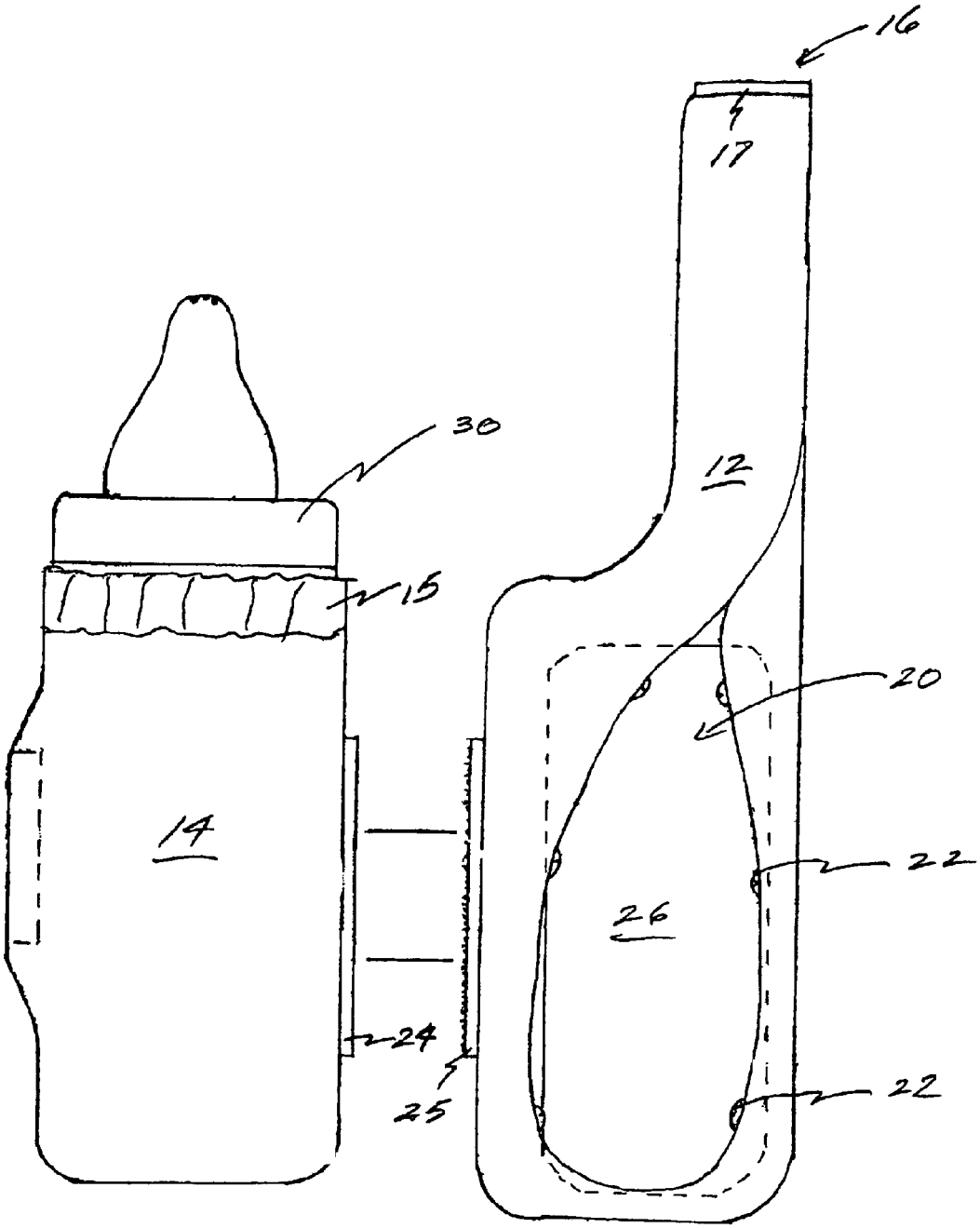
FIG. 2 is a side planar view of an illustrated embodiment 10 from FIG. 1.

Referring now to FIG. 2, there is shown a side planar view of an illustrated embodiment 10 from FIG. 1, with the bottle holder 14, carrying a typical bottle 30, detached. More specifically, there is shown a complimentary attachment strip 25 to attachment strip 24 for securely fastening the bottle holder 14 to the bib 12. There is also shown a pillow pocket 20 for insertion of a pillow 26 into the bib 12. The pillow pocket 20 provides for storage of the pillow during transport of the bib 12 and for providing a soft and spongy surface upon which to rest a bottle 30 when a baby (not shown) may be in need of an elevated bottle during feeding. The pillow pocket 20 may be securely fastened in a closed position with snaps 22.

Figure 3:
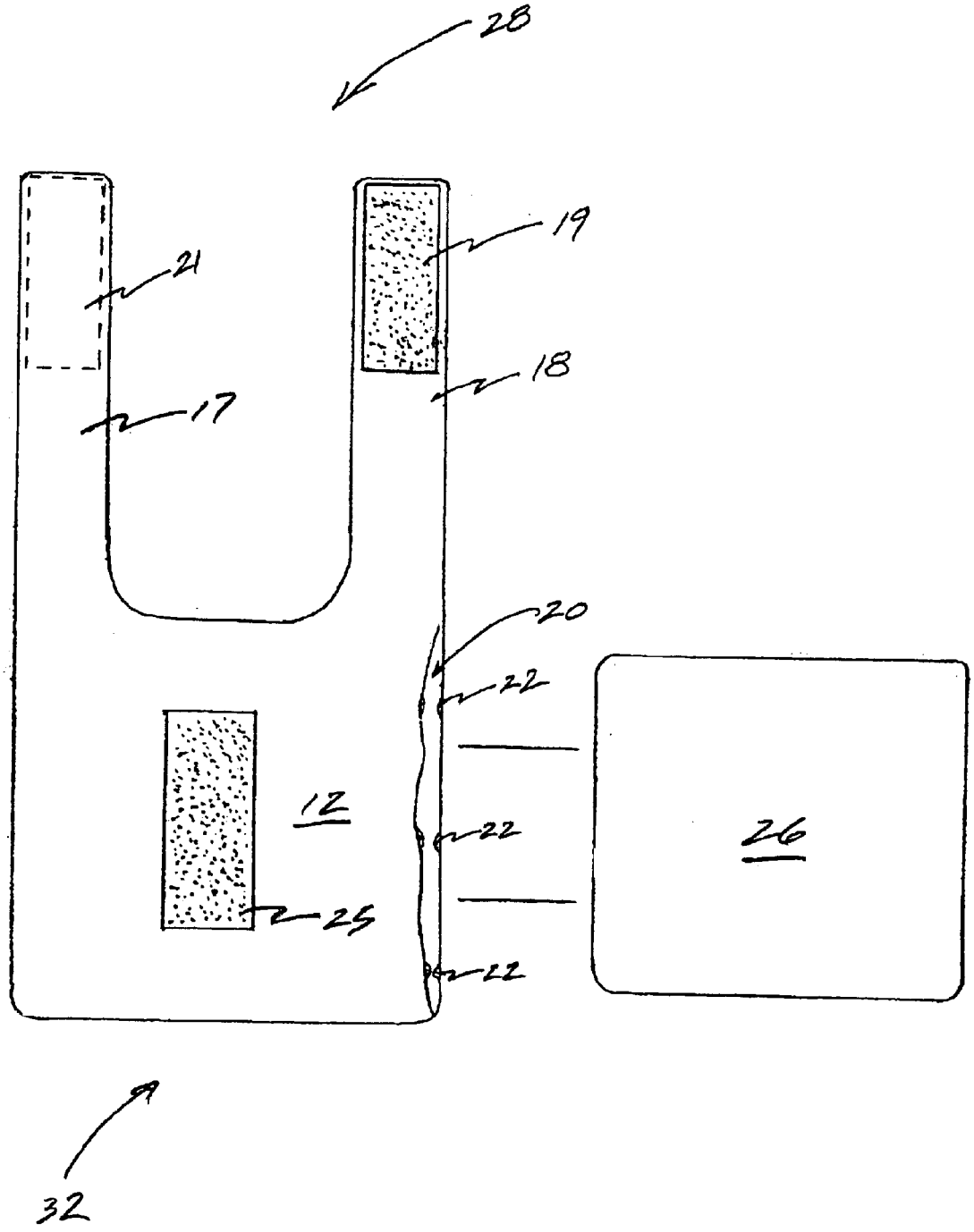
FIG. 3 is a front planar view of an illustrated embodiment 10 from FIG. 1.

Referring now to FIG. 3, there is shown a front planar view of an illustrated embodiment 10 from FIG. 1, with pillow 26 and bottle holder 14 removed, and with neck straps 17 and 18 disconnected. A general forked upper portion of the integrated bottle holder, bib, and pillow 28 is shown in conjunction with a general hollow base portion 32. More specifically, there is additionally shown a strap connection strip 19 with a complimentary strap connecting strip 21 for securely fastening the neck straps 17 and 18 together behind a baby's neck. The strap connection strips 19 and 21 may be made of hook and loop type fastening material as shown.

VARIATIONS OF THE ILLUSTRATED EMBODIMENT(S)

It is understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. For example, in addition to the illustrated configuration, it is noted that the integrated baby bottle holder, bib, and pillow may also be designed so that the pillow pocket opens to an opposite side of the bib, or to the bottom of the bib. With the pillow pocket crafted into the bottom of the bib, removal and insertion of the pillow may be easier with the bib in place around a baby's neck. Further the bib may be designed with two pillow pockets for further versatility and storage capabilities. For example, one pillow pocket could be accessible from a side portion of the bib and a second from the bottom.

Similarly, variations in the type, size, and location of the bottle holder attachment strips and strap connection strips are contemplated. For example, the bottle holder attachment strip and complimentary strip may be attached at a lower portion of the bib to accommodate the particular needs of a care giver or baby. One skilled in the art would recognize that any number of conventional fastener types or shapes would be appropriate to connect the neck straps together or to attach the bottle holder to the bib. For example, VELCRO, hook an loop, snap, button, zipper, ties, or other mechanical connections are contemplated.

In addition, the shape of the bottle holder may be altered to accommodate a variety of baby bottle shapes and sizes. For example, baby bottles with considerably wider mouths and shorter bodies require a bottle holder mirroring those characteristics. Such variations in height, width, and elastic diameter of the bottle holder are contemplated. The bottle holder may also be designed to include a fabric lining, within which the electronic music emitting device may be inserted for activation by a care giver or baby. The tune or song played by the music emitting device may also be coordinated with the design of the integrated baby bottle holder, bib, and pillow such that the patterns or colors of the same relate to the song that is programmed into the music emitting device.

Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A baby feeding accessory, comprising:

a bib having a hollow base portion;

a pair of neck straps attached to the bib configured to wrap around a baby's neck and attach together;

a pillow removably sealed within the hollow base portion of the bib;

a bottle holder that is removably secured to a portion of the bib, wherein the bottle holder includes a bottle holder attachment strip, integrally attached to the bottle holder, configured to releasably attach the bottle holder to a complimentary bottle holder attachment strip on the bib; and wherein upon attachment of the bib to a baby, and insertion of the bottle holder, a nipple of the bottle is positioned to rest inside a mouth of the baby.

2. The baby feeding accessory of claim 1, wherein the pillow is of a size sufficient to fit in the hollow base portion of the bib.

3. The baby feeding accessory of claim 1, wherein the pillow is shaped according to the shape of the hollow base portion.

4. The baby feeding accessory of claim 1, further comprising an electronic music emitting device.

5. The baby feeding accessory according to claim 4, wherein the electronic music emitting device is secured to the baby bottle holder.

6. The baby feeding accessory according to claim 1, wherein the hollow base portion is sealed by at least one snap mechanism.

7. The baby feeding accessory according to claim 1, wherein the pair of neck straps are connected by way of a snap mechanism.

* * * * *